US006252549B1

(12) United States Patent
Derneryd

(10) Patent No.: US 6,252,549 B1
(45) **Date of Patent: *Jun. 26, 2001**

(54) APPARATUS FOR RECEIVING AND TRANSMITTING RADIO SIGNALS

(75) Inventor: Anders Derneryd, Hisings Backa (SE)

(73) Assignee: Telefonaktiebolaget LM Ericsson (publ), Stockholm (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/028,356

(22) Filed: Feb. 24, 1998

(30) Foreign Application Priority Data

Feb. 25, 1997 (SE) ..... 9700667

(51) Int. Cl.[7] ..... H01Q 1/38; H01Q 21/00

(52) U.S. Cl. ..... 343/700 MS; 343/725; 343/770

(58) Field of Search ..... 343/700 MS, 767, 343/770, 725, 729; H01Q 1/38, 21/00

(56) References Cited

U.S. PATENT DOCUMENTS

| | | | | |
|---|---|---|---|---|
| 4,761,654 | | 8/1988 | Zaghloul | 343/700 MS |
| 4,926,189 | | 5/1990 | Zaghloul et al. | 343/700 MS |
| 4,929,959 | | 5/1990 | Sorbello et al. | 343/700 MS |
| 5,005,019 | | 4/1991 | Zaghloul et al. | 343/700 MS |
| 5,189,433 | | 2/1993 | Stern et al. | 343/770 |
| 5,223,848 | | 6/1993 | Rammos et al. | 343/700 MS |
| 5,453,751 | * | 9/1995 | Tsukamoto et al. | 343/700 MS |
| 5,534,877 | * | 7/1996 | Sorbello et al. | 343/700 MS |
| 5,633,613 | * | 5/1997 | MacDonald | 343/700 MS |
| 5,661,493 | * | 8/1997 | Uher et al. | 343/700 MS |
| 5,907,305 | * | 5/1999 | Epp et al. | 343/700 MS |

FOREIGN PATENT DOCUMENTS

| | | | |
|---|---|---|---|
| 0 433 255 | 6/1991 | (EP) | H01Q/5/00 |
| 2 251 520 | 6/1991 | (GB) | H01Q/1/38 |
| 60-113502 | 6/1985 | (JP) | H01Q/13/10 |

OTHER PUBLICATIONS

Baracco, Brachat J.M., "Dual Polarised Aperture Coupled Printed Antennas", pp. 1779–1789, from "Proc. of 16th ESA Workshop on Dual PPolarisation Antenna" in Noordwijk, The Netherlands, Jun. 8th–9th 1993.

* cited by examiner

*Primary Examiner*—Hoanganh Le
*Assistant Examiner*—Hoang Nguyen
(74) *Attorney, Agent, or Firm*—Burns, Doane, Swecker & Mathis, L.L.P.

(57) ABSTRACT

An antenna unit transmit and receives radio signals having two different polarizations. The antenna unit includes a slot integrated in a microstrip element and an aperture integrated in a conductive surface on the microstrip element. The aperture is arranged in the conductive surface parallel to its polarization direction. The slot is arranged in an underlying layer directly below the aperture. The conductive surface of the microstrip element is arranged to transmit or receive with a vertical polarization and a first horizontal beam width. The slot is arranged to transmit or receive with a horizontal polarization and a second horizontal beam width. The second beam width is substantially equal to the first beam width. The antenna unit is very compact and light and only causes low power losses. A number of antenna units can be used to design sector antennas or antenna arrays.

26 Claims, 9 Drawing Sheets

SECTION A-A

APPARATUS FOR RECEIVING AND TRANSMITTING RADIO SIGNALS

This application claims priority under 35 U.S.C. §§119 and/or 365 to SE 9700667-0 filed in Sweden on Feb. 25, 1997; the entire content of which is hereby incorporated by reference.

1. Technical Field

The present invention relates to an antenna device and an antenna apparatus for transmitting and receiving radio signals, in particular one that is located on a base station in a mobile communications system.

2. Background

An important part of the planning and dimensioning of a communications system for radio signals is the properties of the antennas. These properties affect, among other things, the cell planning (size, pattern, number). One of these properties is the radio coverage area of the antenna.

Originally, only so called omni antennas were used, having a coverage in all directions seen from the base station. If a larger coverage area was necessary, a new cell was introduced adjacent to the first one and a new base station was placed in the middle of it.

Later on it was discovered that it was advantageous from a system point of view to divide the coverage area into sectors, for example, three sectors in one full circle. Antennas intended for this coverage are called sector antennas. This becomes particularly advantageous if the base station is placed in the intersection point between the cells. Each of the sector antennas then covers one cell and the base station thus serves several cells at a time.

The coverage area of a sector antenna is determined by the antenna's beam width in the horizontal plane.

Another important property of the antennas is their polarization, or rather the polarization of the signals transmitted or received by the antenna. Originally only vertical polarization was used in the base station antennas. Nowadays, often two linear polarizations are used at the same time (polarization diversity), for example in the horizontal and the vertical planes, here referred to as 0 and 90 degrees, or in the tilted planes between them, +/−45 degrees. Usually the antenna must have the same coverage for both polarizations.

The sector antennas used today for two polarizations have a beam width of approximately 60–70 degrees. At present antennas with a wide lobes can only be made with one polarization direction. Now many operators want antennas for two polarizations having beam widths of 80–90 degrees to adapt the coverage area of the base station to existing systems and the surrounding terrain.

A sector antenna comprises a column with some type of antenna element receiving and/or transmitting in one or two polarizations within a limited coverage area. These antenna elements may be implemented, for example, as so called microstrip elements. A microstrip element has a radiating body in the form of a conducting surface, often called a patch, located in front of an earth plane. The space between them may be filled with a dielectric material or air. Air has the advantages of being light, inexpensive and causing no power loss. For the microstrip element to function efficiently the length of the patch must correspond to a resonant length in the polarization direction, usually about half a wavelength.

The beam width in a certain plane of an antenna is inversely proportional to the dimension of the antenna in the same plane. Base station antennas often have a vertical beam width of 5–15 degrees, which is dictated by the topography of the surroundings of the base station. This beam width may easily be adjusted by changing the number of elements in the vertical direction of the antenna. In the horizontal direction the antenna cannot be made narrower than one element. If, for example, the polarization of the antenna is horizontal, the width of the element is determined by the resonance condition mentioned above.

A known antenna apparatus with two different polarization directions comprises a number of microstrip elements whose radiating elements have a square shape. Each radiating element has two different feeders. One feeder transmits or receives a signal having a certain polarization different from the one transmitted or received by the other feeder. This implies that the microstrip elements must be resonant in two directions (one for each polarization direction) which implies that the width of the radiating elements must correspond to half a wavelength. This in turn means that it is very difficult to generate lobes that are wider than 60–70 degrees. One known way to widen the lobe is to fill the microstrip element with a dielectric substance having a dielectric constant greater than one. This reduces the wavelength and thus also the resonant dimension of the patch. This procedure, however, causes reduced performance because of inevitable power losses in the substance as well as a higher weight and cost.

U.S. Pat. No. 5,223,848 describes an antenna comprising microstrip elements having a pair of rectangular radiating elements. Each radiating element is fed to transmit and receive with both a vertical and a horizontal polarization simultaneously. The radiating elements may be conducting surfaces or other radiating elements. Both radiating elements in the pair transmit and receive on two frequencies with different polarization directions.

SUMMARY

The present invention attacks a problem that arises when a sector antenna implemented using plane conductor technology is to be able to generate efficiently very wide antenna lobes (more than 70 degrees) simultaneously, with two different polarization directions, while at the same time being compact, light and inexpensive.

More specifically, the problem arises when the antenna elements of the antenna must be resonant in two directions to be able to transmit and receive with two polarization directions. This limits the possibility to design a compact, light and inexpensive antenna generating small losses.

A similar problem arises when a narrow sector antenna is to generate two antenna lobes of the same width, and having two different polarization directions, in the horizontal plane.

The purpose of the present invention is thus to achieve a compact, light and inexpensive antenna with small losses having two antenna lobes of substantially the same width, greater than a certain width, and having two different polarization directions.

More specifically the present invention is intended to achieve an antenna in which the width of the antenna lobes in the horizontal plane is greater than 70 degrees.

According to the invention two different types of antenna element are used in one common unit, in which the type and geometrical shape of the antenna elements enable a unit that is as compact and light as possible. Each type of antenna element is arranged to transmit or receive with one particular polarization.

More specifically, the invention relates to an antenna unit having a narrow antenna element of a first type, for example, a microstrip element, in combination with a narrow and light antenna element of a second type, for example, a slot in an earth plane. The first type of antenna element is only designed for a first polarization direction, while the second type of antenna element is only designed for a second polarization direction, different from the first polarization direction. These antenna elements may be arranged to occupy a very small surface. This means that the antenna may be built for antenna lobes greater than a certain angle, for example 70 degrees, without the antenna becoming heavy and/or expensive.

The invention also relates to an antenna apparatus comprising a certain number of said antenna units. These antenna units may, for example, be arranged in a column forming a sector antenna. The sector antenna, too, may be built for antenna lobes greater than a certain angle, for example 70 degrees, without the antenna becoming heavy and/or expensive.

One advantage of the present invention is that the antenna can have a very wide lobe (70–90 degrees) in the horizontal plane for two different polarization directions. When both antenna lobes have substantially the same width, considerable advantages are achieved from a system point of view. Among other things, polarization diversity may be utilized in the whole coverage area of the antenna.

Further advantages is that it becomes very easy to make a compact, light and inexpensive antenna. This is particularly true for sector antennas.

The invention also enables the construction of two dimensional antenna arrays having a distance of less than half a wavelength between the antenna columns (rows of antenna elements). This enables the generation of one or more antenna lobes with great output angles without so called grid lobes being generated.

The antennas mentioned above can also generate one or two circular polarizations in a large angular area, trough a combination of the individual radio signals to the respective antenna elements, in ways known in the art.

BRIEF DESCRIPTION OF THE DRAWINGS

The invention will now be described with reference to the appended drawings.

DETAILED DESCRIPTION

Figure 1:
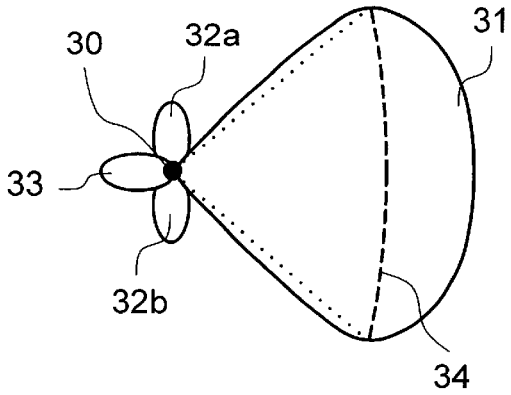
FIG. 1 PRIOR ART
FIG. 1 is an explanatory sketch of antenna lobes from a sector antenna seen from above.

FIG. 1 is a top view of antenna lobes from an antenna 30 transmitting or receiving in a particular direction. Such an antenna 30 is called a sector antenna. The main part of the radiation from a sector antenna is found in a particular limited area 31 referred to as the front lobe of the antenna. So called side lobes 32*a–b* and back lobes 33 also arise. The beam width 34 of the antenna is the part of the front lobe 31 in which the field strength F of the antenna exceeds $F_{max}/\sqrt{2}$ in which $F_{max}$ is the maximum field strength in the front lobe 31.

Figure 2:
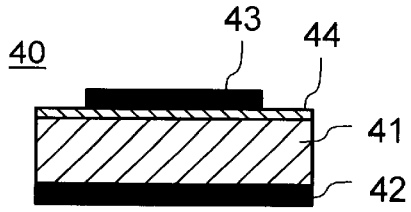
FIG. 2 PRIOR ART
FIG. 2 is a cross-sectional view of a first microstrip element.
Figure 3:
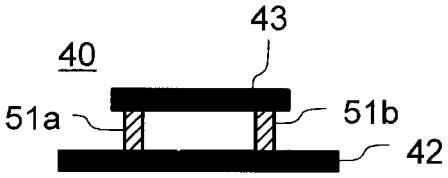
FIG. 3 PRIOR ART
FIG. 3 is a cross-sectional view of a second microstrip element.
Figure 4:
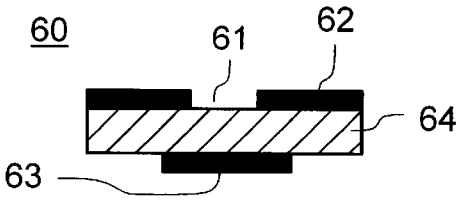
FIG. 4 PRIOR ART
FIG. 4 is a cross-sectional view of a slot in an earth plane with a supply conductor of a plane conductor type.
Figure 5:
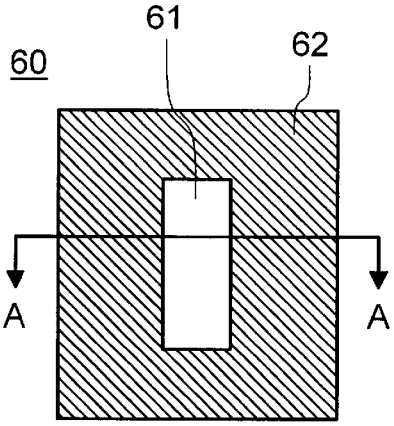
FIG. 5 PRIOR ART
FIG. 5 is a front view of a slot in an earth plane.

Microstrip elements 40, see FIGS. 2–3, and slots in earth planes 60, see FIGS. 4–5, are examples of different types of antenna elements.

FIG. 2 is a cross-section of a first microstrip element 40. The microstrip element 40 comprises an electrically insulating volume 41 having a certain dielectric constant $\in$, an earth plane 42 consisting of an electrically conductive substance, for example, copper, below the insulating volume 41 and a limited surface (patch) 43 of an electrically conductive substance, for example, a square copper surface arranged above the insulating volume 41. The conductive surface 43 is an example of a radiating element that can transmit or receive signals from air. In the following, the conductive surface 43 on the microstrip element 40 will be referred to as a surface element 43. The dimensions of the surface elements 43 are determined, among other things, by the polarization and wavelength of the signal concerned. A sector antenna comprises a column having a well defined number of microstrip elements 40 arranged in a common antenna structure.

The surface element 43 on the microstrip element 40 can, if necessary, be arranged on a disc 44 of an electrically insulating material. The surface element 43 may then be arranged above, as in FIG. 2, or below the disc 44.

The surface element may also be arranged on one or more support units 51*a–b* between the surface element 43 and the earth plane 42, see FIG. 3, which shows another embodiment of a microstrip element 40.

FIG. 4 is a cross-sectional view of an antenna element 60 having a slot 61 in an earth plane 62 and a feeder 63 of a plane conductor type for the supply to and from the slot 61. The feeder 63 to the slot 61 in the earth plane 62 is arranged below the slot 61. An electrically insulating volume 64 is arranged between the feeder 63 and the earth plane 62. Signals to and from the slot 61 are transmitted to/from the feeder 63 by electromagnetic transmission through the volume 64 (the slot 61 is excited).

FIG. 5 is a cross-sectional view of the antenna element 60 comprising the slot 61 in the earth plane 62. The slot 61 in the earth plane 62 is another example of a radiating element which, like the surface element 43 mentioned, can transmit or receive signals from air.

Figure 6:
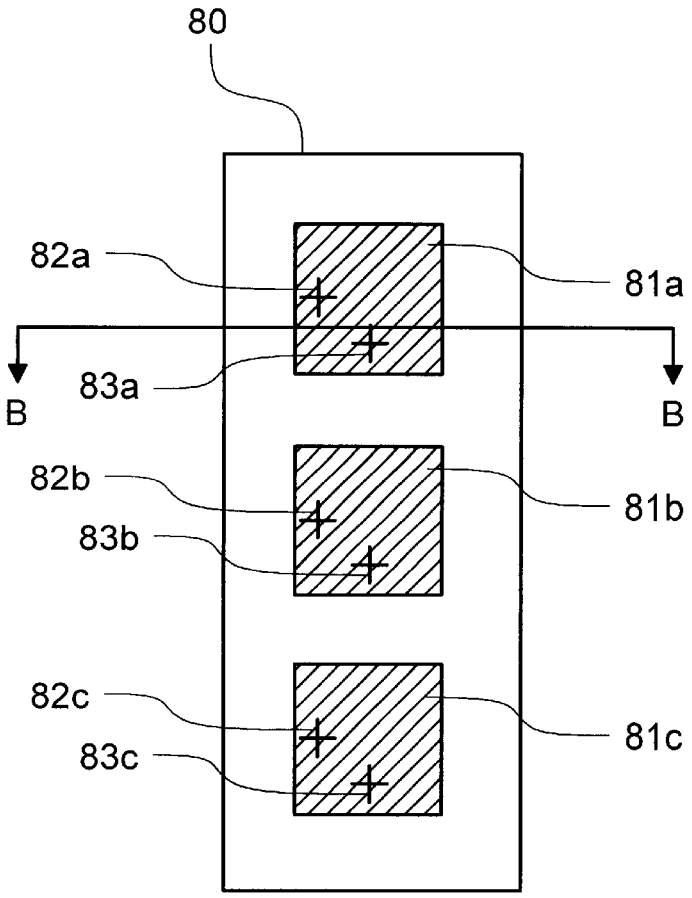
FIG. 6 PRIOR ART
FIG. 6 is a front view of microstrip elements which can transmit and/or receive with two different polarization directions.

As mentioned above a prior art antenna uses microstrip elements having square radiating elements of the surface element type, which can transmit and/or receive with two different polarization directions from each surface element. FIG. 6 is a view of such an antenna 80 comprising three surface elements 81*a–c*. The surface elements 81*a–c* are resonant in two directions (horizontally and vertically) in order to generate the 0/90 degrees polarization mentioned above. Each surface element 81*a–c* has a feeder 82*a–c* for the horizontal polarization and a feeder 83*a–c* for the vertical polarization.

Figure 7:
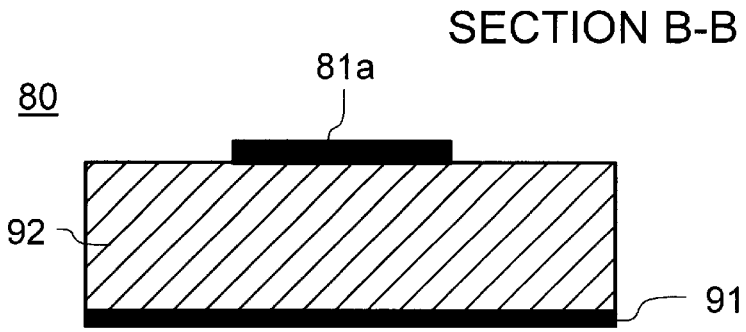
FIG. 7 PRIOR ART
FIG. 7 is a cross-sectional view of the antenna shown in FIG. 6.

FIG. 7 (cf. FIG. 2) is a cross-sectional view of the antenna 80 with the surface element 81*a* and an underlying earth plane 91. Between them, a dielectric volume 92 is arranged. If the dielectric volume 92 is air the beam width 34 of the front lobe 31, see FIG. 1, will be between 60 and 70 degrees in the two polarization directions.

The size of the antenna 80 may be reduced by selecting a dielectric volume 92 having a dielectric constant $\in_r$ greater than, for example, 2, thus achieving a wide front lobe 31. This, however, increases the loss in the antenna 80 and makes it heavier and more expensive.

Figure 8:
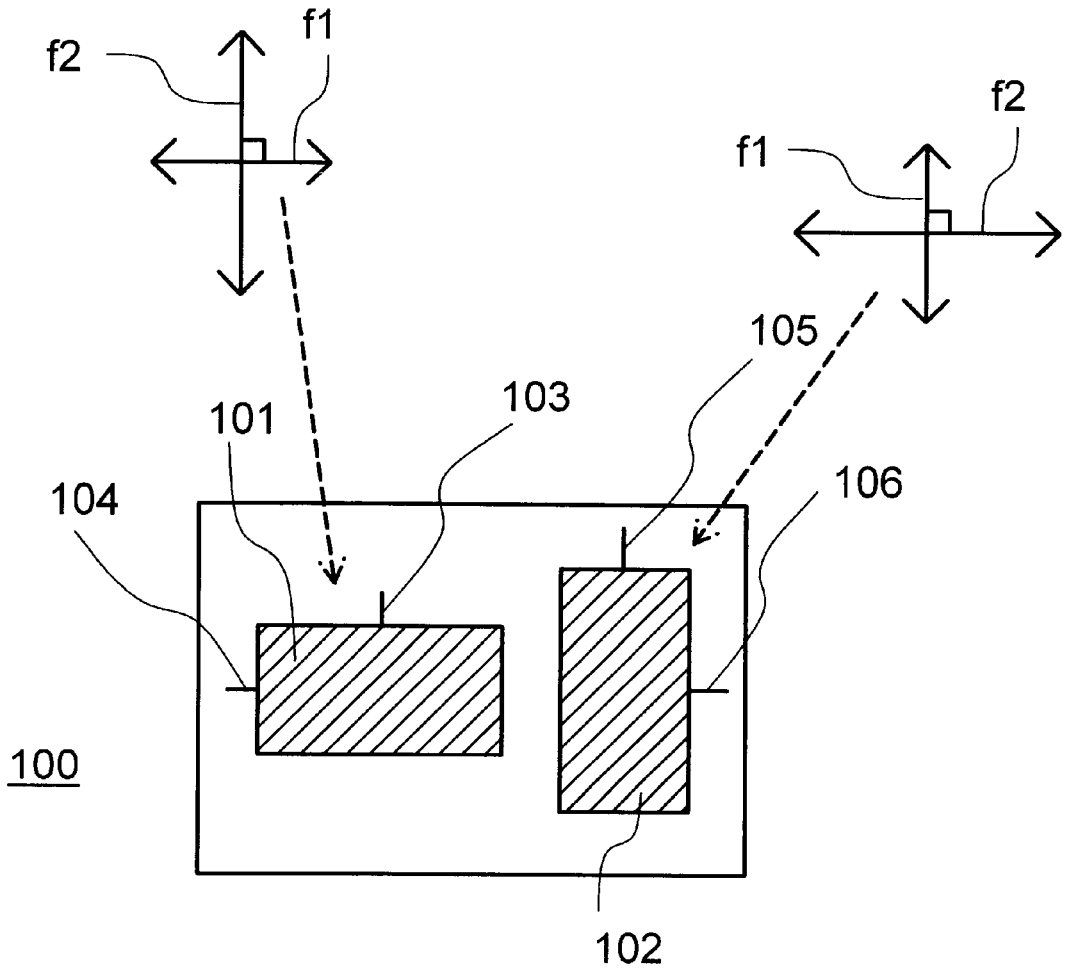
FIG. 8 PRIOR ART
FIG. 8 is a front view of a second prior art antenna.

FIG. 8 shows an antenna 100 having microstrip elements according to the above mentioned U.S. Pat. No. 5,223,848. A first 101 and a second 102 rectangular surface element have two feeders 103–106 each, for two different polarization directions per surface element 101–102. Each surface element 101–102 transmits and receives with two different frequencies fl and f2. A first frequency fl is used for the horizontal polarization in the first surface element 101 and for the vertical polarization in the second surface element 102, whereas the other frequency f2 is used for the vertical polarization in the first surface element 101 and for the horizontal polarization in the second surface element 102. These surface elements 101–102 may be replaced by another type of radiating element with two feeders.

In the embodiments described below the antennas are designed with a layer type structure. The antennas are described as if horizontally oriented and having an upper, a lower and an intermediate layer. Of course the antennas may be arranged with another orientation, for example, standing, in which case the upper layer corresponds to a front layer, the lower layer corresponds to a back layer and something being located under the antenna corresponds to something being located behind it.

Figure 9:
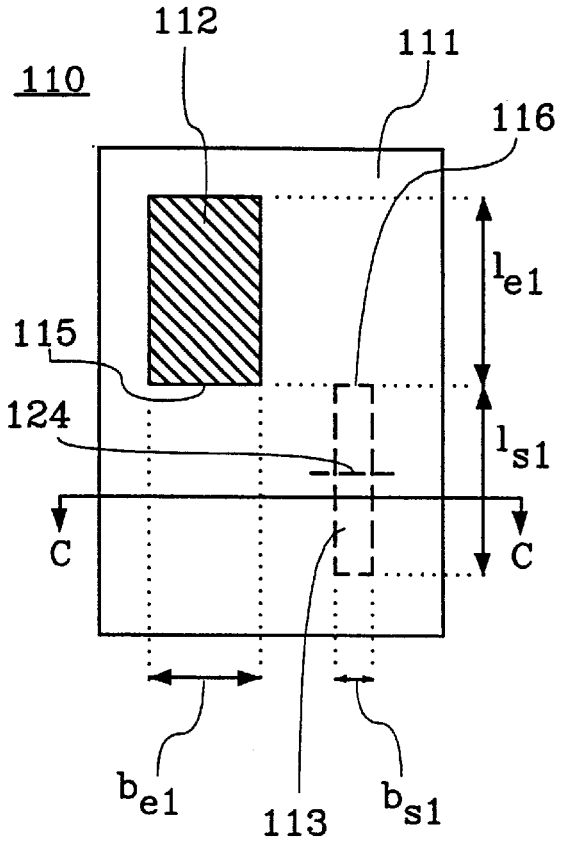
FIG. 9 is a front view of a first embodiment of an inventive antenna unit.

FIG. 9 is a front view of a first embodiment 110 of an antenna unit according to the present invention, for transmitting and receiving with a polarization of 0/90 degrees. The antenna unit 110 is here shown in a rectangular design. The antenna unit 110 comprises a combination of a microstrip element 111 having a rectangular surface element 112 in the upper layer and a rectangular slot 113 in an earth plane 114 in the intermediate layer (the earth plane is not shown in FIG. 9).

The surface element 112 has a well defined length $l_{e1}$ and width $w_{e1}$. The slot 113 also has a well defined length $l_{s1}$ and width $w_{s1}$. These lengths $l_{e1}$ and $l_{s1}$ are dependent on the wavelength with which the antenna unit is to transmit and receive. The width $w_{el}$ determines the beam width of the element in the horizontal plane. The width $w_{s1}$ substantially determines the bandwidth of the slot. The surface element 112 is arranged on the antenna unit 110 so that, for example, its lower edge 115 levels with an upper edge 116 of the slot 113.

Figure 10:
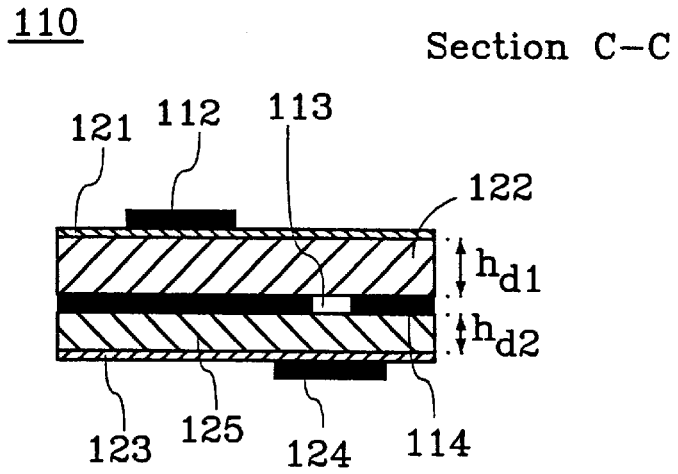
FIG. 10 is a cross-section of the antenna unit shown in FIG. 9.

FIG. 10 is a cross-sectional view of the antenna unit 110. The antenna unit 110 comprises a first disc 121 of an electrically insulating material, in the upper layer of which the surface element 112 is arranged. In the lower layer a second disc 123 of an electrically insulating material is arranged having a feeder 124 to the slot 113. In the intermediate layer an earth plane 114 is arranged. The slot 113 is arranged in the earth plane 114 so that it is not covered by a thought projection of the surface element 112 onto the earth plane 114. A first dielectric volume 122, for example air, is arranged between the first disc 121 of an electrically insulating material and the earth plane 114. A second dielectric volume 125, for example air, is arranged between the earth plane 114 and the second disc 123 of an electrically insulating material. If the dielectric volumes 122 and 125 consist of air, of course, side walls are arranged in a suitable way to support the discs 121 and 123, and the earth plane 114.

The earth plane 114 may, for example, consist of an electrically conductive material comprising said slot 113 or a disc of an electrically conductive material on which an electrically conductive surface with the slot 113 is arranged.

Figure 11:
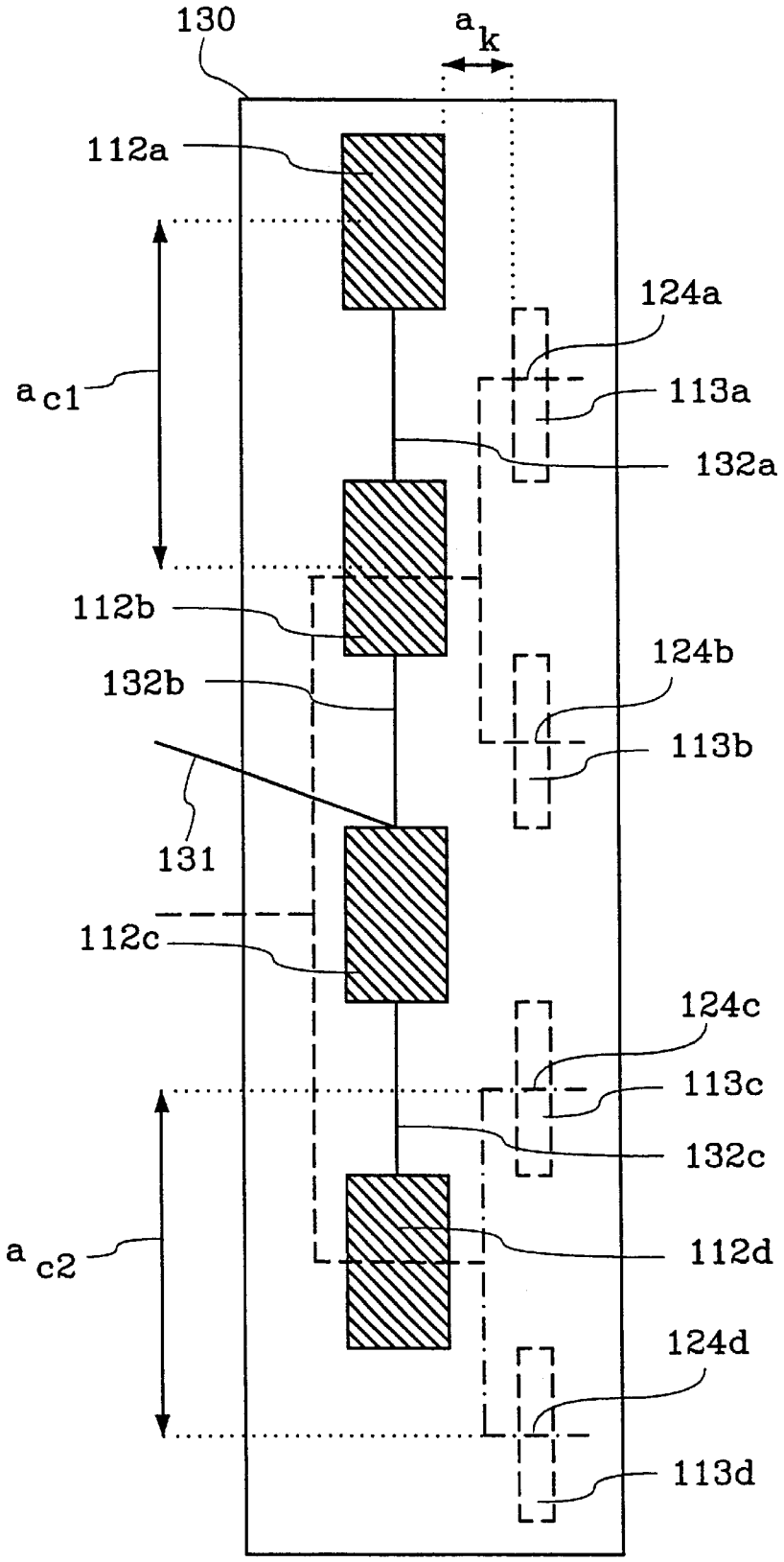
FIG. 11 is a front view of a first embodiment of a sector antenna comprising the first embodiment of the inventive antenna unit.

FIG. 11 is a front view of a first embodiment of a sector antenna 130 comprising the first embodiment of the inventive antenna unit, to transmit and receive with a polarization of 0/90 degrees. The antenna 130 is here shown in a rectangular embodiment. The antenna 130 comprises four antenna units 110*a–d* (not marked out in FIG. 11) each similar to the ones shown in FIGS. 9 and 10, and arranged one after the other, the antenna units 110*a–d* being integrated with each other in a common structure.

The rectangular surface elements 112*a–d*, see FIG. 11, of the respective antenna unit 110*a–d*, are arranged in a column, short sides facing each other, with a certain, for example constant, first centre distance $a_{c1}$ between the centres of the surface elements. They are also arranged so that their longitudinal axes are parallel with the longitudinal axis of the antenna. The centre distance $a_{c1}$ corresponds to a wavelength in the medium in which the wave is propagating when passing through feeders and microstrip elements.

The slots 113*a–d* in the earth plane 114 of each respective antenna unit 110*a–d* are also arranged in a column, short sides facing each other, with a certain, for example, constant second centre distance $a_{c2}$ between the centres of the slots 113*a–d*. The slots are arranged so that their longitudinal axes are parallel with the longitudinal axis of the antenna. It is feasible to let the centre distance $a_{c2}$ be equal to the centre distance $a_{c1}$.

The column comprising the surface elements 112*a–d* and the column comprising the slots 113*a–d* are parallel displaced relative to each other and in the longitudinal direction of the sectors antenna. The columns are arranged with a certain distance $a_k$ between them. The distance $a_k$ is selected so that the function of the slots 113*a–d* is not disturbed by the surface elements 112*a–d*.

The surface elements 112*a–d* are fed through a central feeding cable 131 and serially connected, from 112*c* to 112*d* and from 112*c* to 112*a*, respectively, by means of three feeders 132*a–c* for the feeding to and from the surface elements 112*a–d*. This implies that the surface elements 112*a–d* can transmit or receive with a vertical polarization with a first horizontal beam width 34.

FIG. 11 also shows how the feeders 124*a–d* for the supply to and from the slots 113*a–d* are connected in parallel with the respective slot 113*a–d*. The feeders 124*a–d* are arranged to excite the slots 113*a–d* so that they can transmit or receive with a horizontal polarization with a second horizontal beam width 34. The second beam width is substantially equal to the first beam width.

The supply and the feeders to/from the slots 113*a–d* and the surface elements 112*a–d* can be arranged in more ways than what has been shown and described in connection with FIG. 11.

The feeders 132*a* and 132*c* to the surface elements 112*a* and 112*d* can, for example, be connected directly to the central supply conductor 131 by parallel feeding. The supply to/from the surface elements 112*a–d* can also be arranged by means of a probe supply or an aperture supply instead of the central supply conductor 131.

An apparatus for fixing the parts of the antenna 130 relative to each other may comprise, for example, a bar around the antenna 130, suitable side walls or a support unit on either side of the antenna 130. Another example is an enclosing housing, for example, a radome. Having an apparatus for fixing the parts is particularly useful when the dielectric volumes 122 and 125 consist of air.

An example of dimensions for a sector antenna 130 according to the first embodiment and with a wavelength of 16 cm is given in the following:

Length of surface elements $l_{e1}$=7.5 cm

Width of surface elements $w_{e1}$=4 cm

Length of slots $l_{s1}$=8 cm

Width of slots $w_{s1}$=0.5 cm

Distance $a_k$=1 cm

Height of the first dielectric volume $h_{d1}$=1 cm

Height of the second dielectric volume $h_{d2}$=0.2 cm.

The dimensions listed above are estimated.

Figure 12:
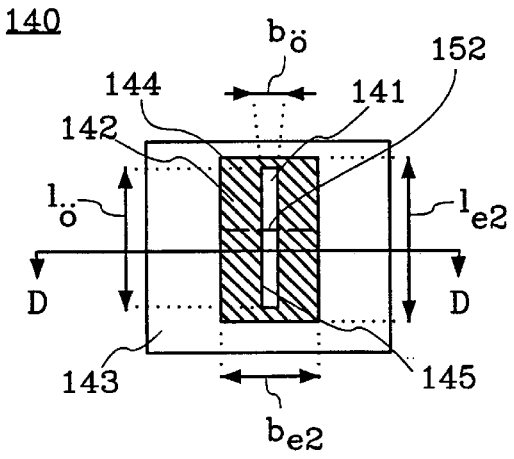
FIG. 12 is a front view of a second embodiment of the inventive antenna unit.

FIG. 12 is a front view of a second embodiment 140 of the inventive antenna unit for transmitting and receiving with a polarization of 0/90 degrees. The antenna unit 140 is here shown in a rectangular design. The embodiment is based on the first embodiment in connection with FIG. 9, the antenna unit 140 comprising a slot 151, see FIG. 13, integrated in a microstrip element 143, see FIG. 12, and an aperture 141 integrated in a surface element 142 on the microstrip element 143. The surface element 142 with the integrated opening 141 will in the following be referred to as a radiating unit 144. The aperture 141 is arranged in the surface element 142 parallel to its polarization direction in order not to intercede any current paths. This implies that the risk of a signal coupling between the two orthogonal polarization directions of the antenna unit 140 will be negligible. The surface element 142 has a well defined length $l_{e2}$ and width $w_{e2}$. The length $\mathbf{1}_{e2}$ is dependent on the wavelength with which the antenna unit 140 is to transmit and receive. The width $w_{e2}$ determines the beam width of the surface element in the horizontal plane.

FIG. 12 shows the aperture 141 having a well defined length $\mathbf{1}_a$ and width $w_a$ held within the surface element 142. The length $l_a$ of the aperture can also be longer than the length $\mathbf{1}_{e2}$ of the surface element, in which case the surface element will be divided into two elongated portions 191*a–b*, see FIG. 19. The surface element may also comprise more than two elongated portions 191*a–c* with apertures 192*a–b* between the portions. Such a surface element is commonly referred to as a gridded patch, see the article "Dual Polarised Aperture Coupled Printed Antennas", pp. 79–89, from "Proc. Of 16$^{th}$ ESA Workshop on Dual Polarisation Antennas" in Noordwijk, The Netherlands, Jun. 8$^{th}$ –9$^{th}$, 1993.

Figure 13:
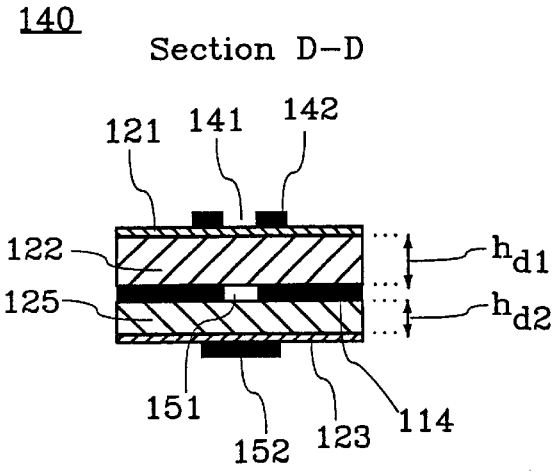
FIG. 13 is a cross-sectional view of the antenna unit shown in FIG. 12.

FIG. 13 is a cross-sectional view of the antenna unit 140. The antenna unit 140 comprises the first disc 121 of an electrically insulating material in the upper layer on which the radiating unit 144 (not marked out in FIG. 13) as shown in FIG. 12 is arranged, the intermediate layer with the earth plane 114, and the first dielectric volume 122, for example air, between them. In the earth plane 114, the slot 151 is arranged. The slot 151 is arranged directly below the aperture 141. The second dielectric volume 125, for example air, is arranged between the earth plane 114 and the second disc 123 of electrically insulating material in the lower layer of which a feeder 152 to the slot 151 is arranged. If the dielectric volumes 122 and 125 consist of air, of course, side walls are arranged in a suitable way to support the discs 121 and 123 and the earth plane 114.

The earth plane 114 may also in this case consist of, for example, an electrically conductive material with said slot 151 or a disc of an electrically insulating material, on which an electrically conductive surface comprising the slot 151 is arranged.

The slot 151 has a predetermined $\mathbf{1}_{s2}$ and width $w_{s2}$, for example, coinciding with the well defined length $\mathbf{1}_a$ and width $w_a$ of the aperture 141. The well defined length $\mathbf{1}_{s2}$ is dependent on the wavelength with which the antenna unit 140 is to transmit and receive. The width $w_{s2}$ substantially determines the bandwidth of the slot.

The antenna unit 140 can be used, with an addition of technology known in the art, to generate a circular polarization in a large angular area.

Figure 14:
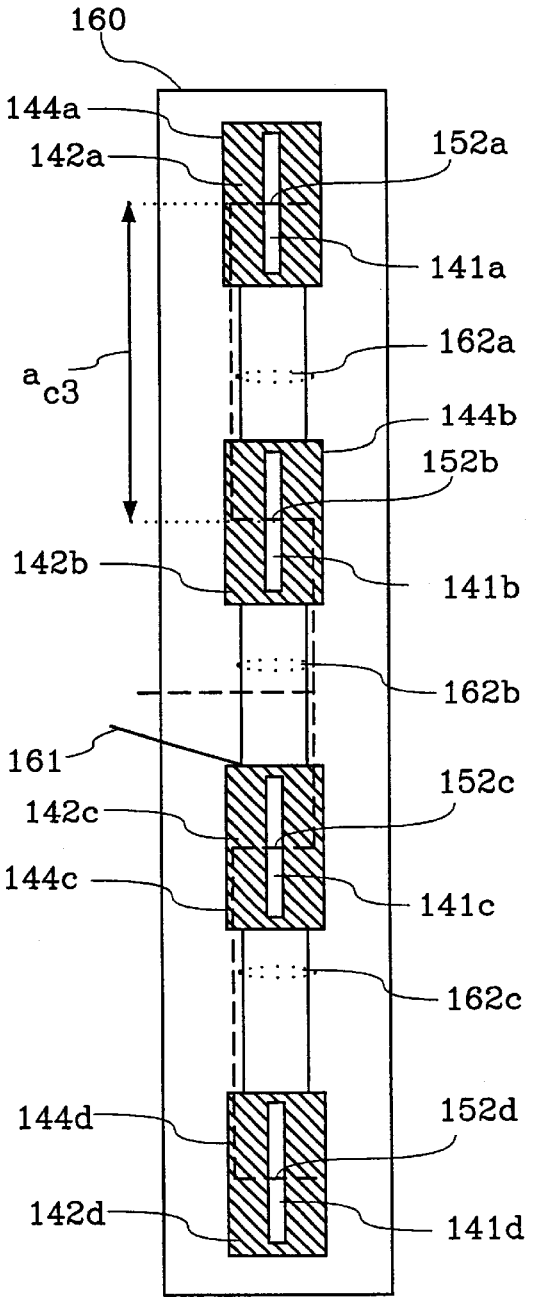
FIG. 14 is a front view of a second embodiment of the sector antenna comprising the second embodiment of the inventive antenna unit.

FIG. 14 is a front view of a second embodiment of a sector antenna 160 comprising the second embodiment of the inventive antenna unit, for transmitting and receiving with a polarization of 0/90 degrees. The antenna 160 is here shown having a rectangular design. The antenna 160 comprises four antenna units 140*a–d* (not marked out in FIG. 14), each similar to the ones shown in FIGS. 12 and 13 and arranged one after the other in a common structure. This means that the antenna 160 comprises four rectangular radiating units 144*a–d* in the upper layer and four slots 151*a–d* (not shown in FIG. 14) in the intermediate layer.

The rectangular radiating units 144*a–d* on the respective antenna unit 140*a–d* are arranged in a column, the short sides facing each other, with a certain, for example, constant centre distance $d_{c3}$ between the centres of the radiating units 144*a–d*. The radiating units 144*a–d* are also positioned in such a way that their longitudinal axes are parallel to the longitudinal axis of the antenna. The centre distance $d_{c3}$ correspond to a wavelength in the medium in which the wave is propagating when passing through feeders and microstrip elements.

The surface elements 142*a–d* in the respective radiating unit 144*a–d* are supplied through a central supply conductor 161 and serially connected., from 142*c* to 142*d* and from 142*c* to 142*a*, respectively, by means of three pairs of parallel feeders 162*a–c*. Because of the serial feeder, the surface elements 142*a–d* can transmit or receive with a vertical polarization and a first horizontal beam width 34. Because of the parallel connectors 162*a–c* the current distribution over the surface elements will be even.

FIG. 14 also shows how the feeders 152*a–d* for the supply to/from the slots 151*a–d* (not shown in FIG. 14) in the respective antenna unit 140*a–d* are serially connected. Each of the feeders 152*a–d* is arranged under the corresponding slot 151*a–d* to excite them in a predetermined way. The slots 151*a–d*, in turn, radiate through the apertures 141*a–d* in the radiating units 144*a–d* so that they can transmit or receive with a horizontal polarization with a second horizontal beam width 34. The second beam width is substantially equal to the first beam width.

The supply and the feeders to and from the slots 151*a–d* and the surface elements 142*a–d* can be arranged in more ways than what was shown and described in connection with FIG. 14. The feeders 152*a–d* to the slots 151*a–d* can, for example, be arranged in the same way as the feeders 124*a–d* to the slots 113*a–d* in FIG. 11.

An apparatus for fixing the parts of the antenna 160 man, for example, comprise a bar around the antenna 160, suitable side walls or a support unit on either side of the antenna 160. Another example is a surrounding housing, for example, a radome. Having a device for fixing the parts is particularly useful when the dielectric volumes 122 and 125 consist of air.

An example of the dimensions of a sector antenna 160 according to the second embodiment, having a wavelength of 16 cm, is given in the following:

Length of surface elements $l_{e2}$=7.5 cm

Width of surface elements $w_{e1}$=4 cm

Length of apertures $l_a$=Length of slots $l_{s2}$=7 cm

Width of apertures $w_a$=Width of slots $w_{s2}$=0.5 cm

Height of the first dielectric volume $h_{d1}$=1 cm

Height of the second dielectric volume $h_{d2}$=0.2 cm.

The dimensions listed above are estimated.

Figure 15:
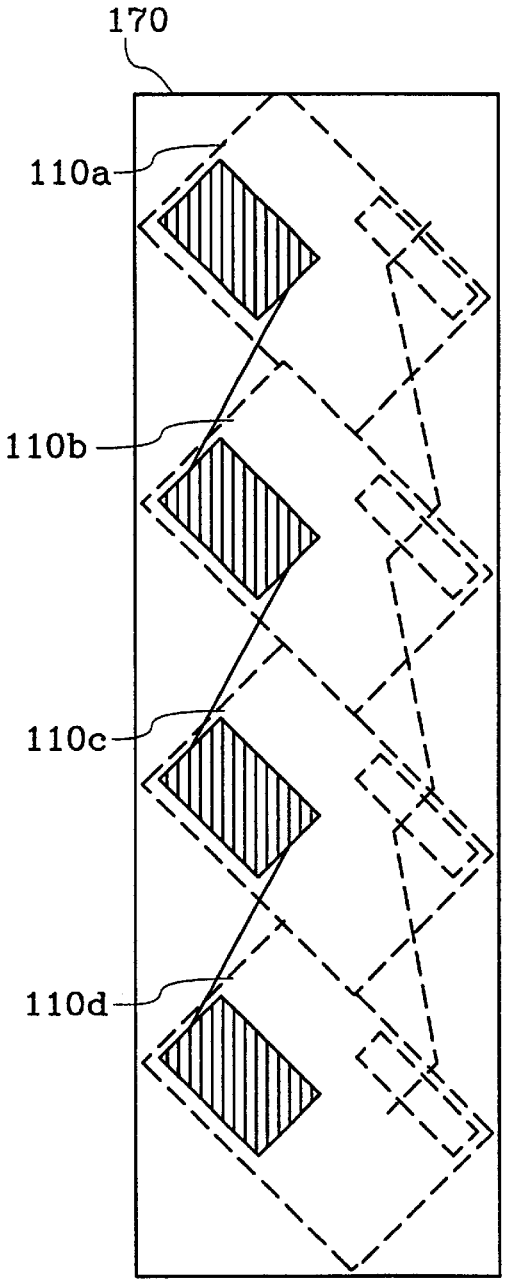
FIG. 15 is a front view of a third embodiment of the sector antenna comprising the first embodiment of the inventive antenna unit.

FIG. 15 is a front view of a third embodiment of a sector antenna 170 comprising the first embodiment of the inventive antenna unit as shown in FIGS. 9 and 10. The third embodiment is based on the first embodiment in connection with FIG. 11. The sector antenna 170 comprises four antenna units 110*a–d* according to the first embodiment, arranged one after the other, the antenna units being integrated in a common structure. The antenna units 110*a–d* are described in more detail in connection with FIGS. 9 and 10. The antenna units 110*a–d* are tilted 45 degrees anticlockwise relative to the first embodiment (FIG. 11) of the sector antenna 130. This implies that the antenna 170 can transmit and receive with a polarization of ±45 degrees. The beam widths of the two polarizations are substantially equal. Apart from this, the design of the antenna corresponds to that of the antenna 130.

The antenna units 110*a–d* may also be tilted an arbitrary number of degrees clockwise or anticlockwise.

Figure 16:
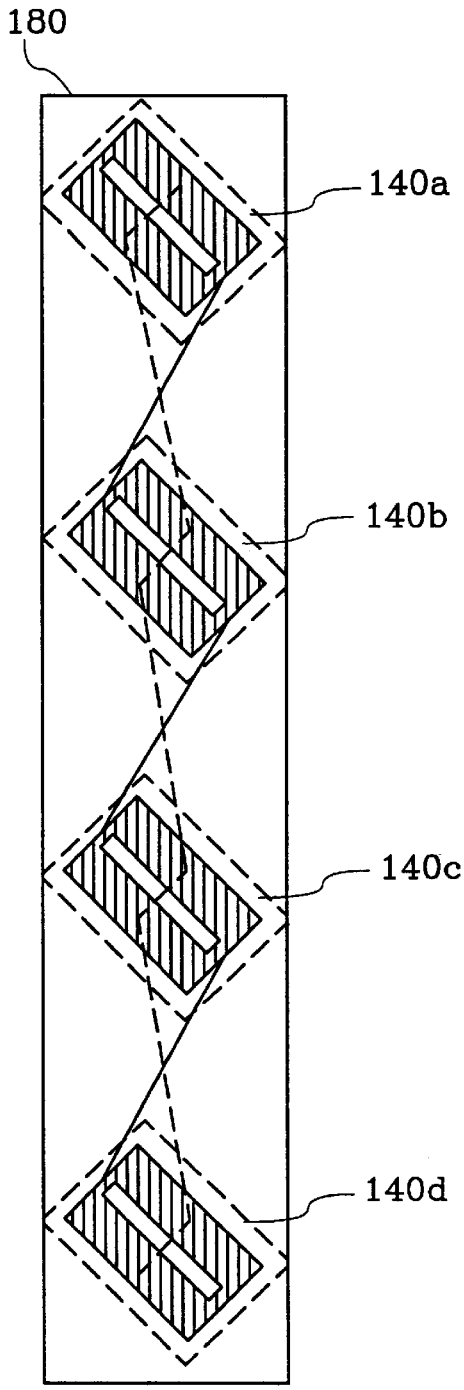
FIG. 16 is a front view of a fourth embodiment of the sector antenna comprising the second embodiment of the inventive antenna unit.

FIG. 16 shows a fourth embodiment of a sector antenna 180 comprising the second embodiment of the inventive antenna unit, as shown in FIGS. 12 and 13. The fourth embodiment is based on the second embodiment in connection with FIG. 14. The sector antenna 180 comprises four antenna units 140*a–d* according to the second embodiment, arranged one after the other, the antenna units 140*a–d* being integrated in a common structure. The antenna units 140*a–d* are described in more detail in connection with FIGS. 12 and 13. The antenna units 140*a–d* are tilted 45 degrees anticlockwise relative to the second embodiment (FIG. 14) of the sector antenna 160. This implies that the sector antenna 180 can transmit and receive with a polarization of ±45 degrees. The beam widths of the two polarizations are substantially equal. Apart from that, the design of the sector antenna 180 corresponds to that of the sector antenna 160.

The antenna units 140*a–d* may also be tilted an arbitrary number of degrees clockwise or anticlockwise.

Figure 17:
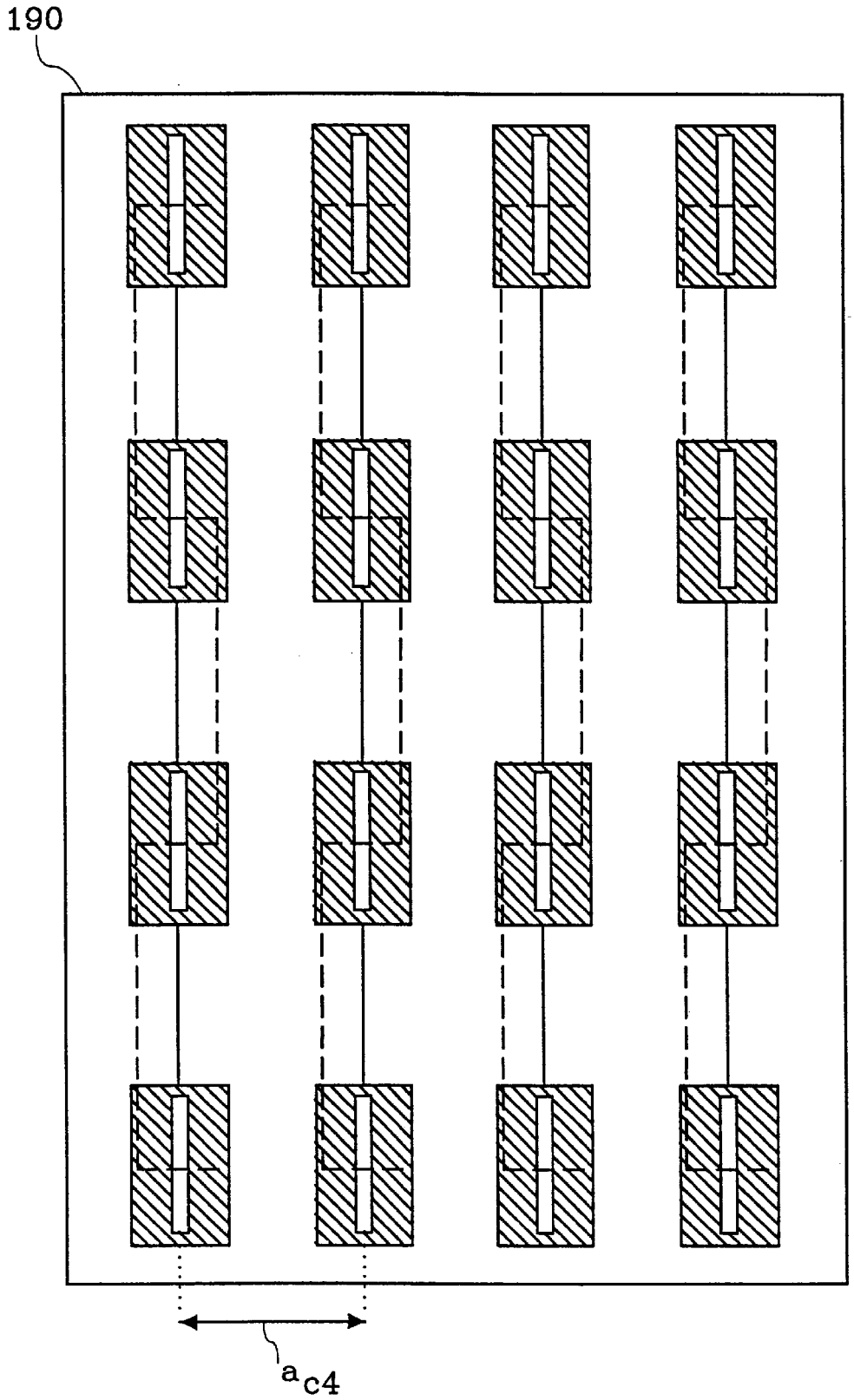
FIG. 17 is a front view of an embodiment of an antenna array comprising the second embodiment of the inventive antenna.

FIG. 17 is a front view of an embodiment of an antenna array 190 comprising the second embodiment of the inventive antenna unit as shown in FIGS. 12 and 13 for transmitting and receiving in two polarization directions. The embodiment is based on the second embodiment in connection with FIG. 14. The antenna array 190 comprises four parallel columns, each having four antenna units 140*a* according to the second embodiment, in each column. The antenna units 140 are integrated in a common structure forming a two-dimensional antenna array 190. Each column may be connected, in a way known in the art, and separately for each polarization, to lobe shaping networks for generating one or more fixed or adjustable lobes in the horizontal plane. A centre distance $d_{c4}$ between the centre lines of the columns may be smaller than a distance corresponding to half a wavelength in air. This enables large output angles from the antenna 190 and prevents the generation of gridded lobes.

The centre distance $d_{c4}$ may be selected, for example to 7 cm for an antenna array having a wavelength of 16 cm.

Figure 18:
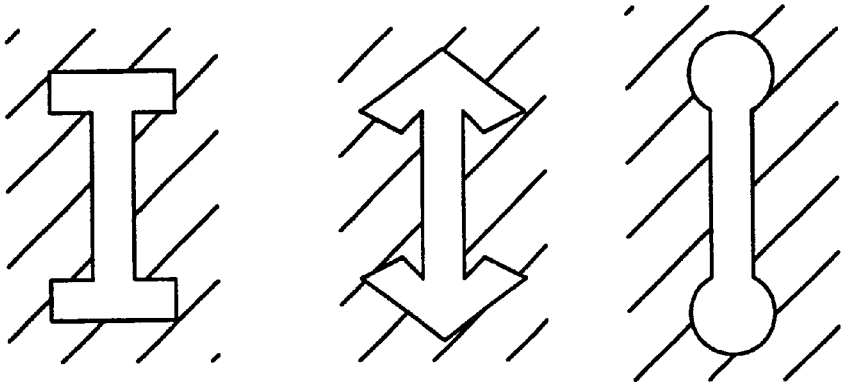
FIG. 18 shows three examples of slots that may be used in all the embodiments listed above.

In the examples of the invention described above, the slots 113*a–d*, 151*a–d* and the apertures 141*a–d* are rectangular. They may also have other shapes. FIG. 18 shows three examples of different shapes of the slots 113*a–d* and 151*a–d*. Their shapes are shown in FIG. 18.

Figure 19:
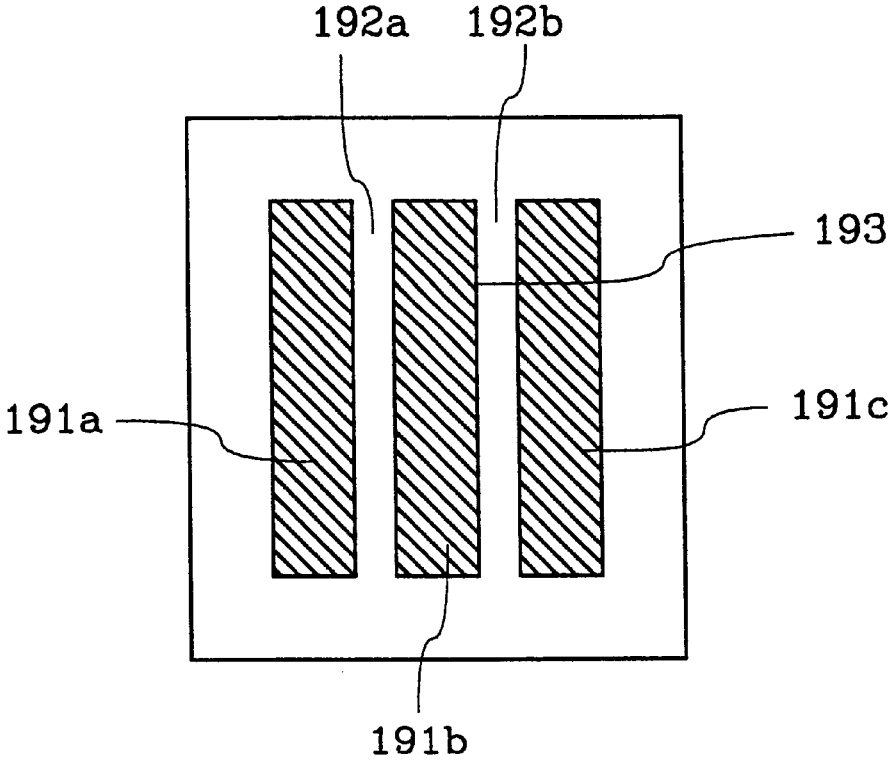
FIG. 19 is a front view of an example of a gridded patch.

FIG. 19 was described in connection with FIG. 12.

What is claimed is:

1. An antenna unit for transmitting and receiving radio signals, comprising a first antenna element for transmitting and receiving in a first polarization direction with a first beam width; and a second antenna element for transmitting and receiving in a second polarization direction with a second beam width, wherein the first antenna element is a single microstrip element comprising a radiating element of the type surface element, the second antenna element is a single slot in an earth plane, each of the first and second antenna elements is arranged to transmit and receive only one polarization direction, the first and second antenna elements are arranged in a one-to-one relationship, and the first and second beam widths are wider than 70 degrees.

2. An antenna unit according to claim 1, wherein the first and the second beam widths of the respective antenna elements are of substantially equal size in a common plane.

3. A antenna unit according to claim 1, the first antenna element is arranged so that its polarization direction is substantially orthogonal to the polarization direction of the second antenna element.

4. An antenna unit according to claim 1, wherein the surface element is rectangular, and the slot is rectangular.

5. An antenna unit according to claim 1, further comprising a first and a second dielectric volume;

a feeder to the surface element in the microstrip element, arranged to transfer signals to and from the surface element in only the first polarization direction; and a feeder to the slot for transferring signals to and from the slot in only the second polarization direction.

6. An antenna unit according to claim 5, wherein the surface element, the feeder to the surface element, the earth plane having the slot, and the feeder to the slot are arranged in a layered structure.

7. An antenna unit according to claim 1, wherein the first and second antenna elements operate in the same frequency band.

8. An apparatus according to claim 1, wherein the microstrip element is a patch, and the slot is a single slot, such that there is a one-to-one relationship between the first antenna element and the second antenna element.

9. An antenna unit transmitting and receiving radio signals, comprising:

a first antenna element of a first type for transmitting and receiving in a first polarization direction with a first beam width, the first antenna element being a microstrip element comprising a rectangular radiating element of the type surface element;

a second antenna element for transmitting and receiving in a second polarization direction with a second beam width, the second antenna element being a rectangular slot in an earth plane;

a first and a second dielectric volume;

a feeder to the surface element in the microstrip element, arranged to transfer signals to and from the surface element in only the first polarization direction; and a feeder to the slot for transferring signals to and from the slot in only the second polarization direction;

wherein each of the first and second antenna elements is arranged to transmit and receive only one polarization direction; the first and second beam widths are wider than 70 degrees; the surface element, the feeder to the surface element, the earth plane having the slot, and the feeder to the slot are arranged in a layered structure; and the surface element and the feeder to the slot form two outer layers, the earth plane having the slot being arranged between them in such a way that the surface element does not overlap the slot when viewed from above the earth plane.

10. An antenna unit according to claim 9, wherein the surface element and the feeder to the surface element are arranged on a first disc of an electrically insulating material in one of the outer layers, the feeder to the slot being arranged on a second disc of an electrically insulating material in the other outer layer.

11. An antenna unit for transmitting and receiving radio signals, comprising:

a first antenna element of a first type for transmitting and receiving in a first polarization direction with a first beam width, the first antenna element being a microstrip element comprising a rectangular radiating element of the type surface element;

a second antenna element for transmitting and receiving in a second polarization direction with a second beam width, the second antenna element being a rectangular slot in an earth plane;

a first and a second dielectric volume;

a feeder to the surface element in the microstrip element, arranged to transfer signals to and from the surface element in only the first polarization direction; and a feeder to the slot for transferring signals to and from the slot in only the second polarization direction;

wherein each of the first and second antenna elements is arranged to transmit and receive only one polarization direction; the first and second beam widths are wider than 70 degrees; the surface element, the feeder to the surface element, the earth plane having the slot, and the feeder to the slot are arranged in a layered structure; and the first dielectric volume is arranged between the surface element and the earth plane having the slot, and the second dielectric volume is arranged between the earth plane having the slot and the feeder to the slot.

12. An antenna unit for transmitting and receiving radio signals, comprising:

a first antenna element of a first type for transmitting and receiving in a first polarization direction with a first beam width, the first antenna element being a microstrip element comprising a rectangular radiating element of the type surface element;

a second antenna element for transmitting and receiving in a second polarization direction with a second beam width, the second antenna element being a rectangular slot in an earth plane;

a first and a second dielectric volume;

a feeder to the surface element in the microstrip element, arranged to transfer signals to and from the surface element in only the first polarization direction; and a feeder to the slot for transferring signals to and from the slot in only the second polarization direction;

wherein each of the first and second antenna elements is arranged to transmit and receive only one polarization direction; the first and second beam widths are wider than 70 degrees; and at least one aperture is integrated in the surface element forming a radiating unit in which the longitudinal side of the aperture is arranged in the surface element parallel to the polarization direction of the surface element.

13. An antenna unit according to claim 12, wherein the radiating unit, the feeder to the surface element, the earth plane having the slot, and the feeder to the slot are arranged in a layered structure.

14. An antenna unit according to claim 12, wherein the radiating unit and the feeder to the slot form two outer layers, the earth plane having the slot being arranged between them so that the slot is substantially parallel to the aperture.

15. An antenna unit according to claim 14, wherein the radiating unit and the feeder to the surface element are arranged on a first disc of an electrically insulating material in one of the outer layers, the feeder to the slot being arranged on a second disc of an electrically insulating material in the other outer layer.

16. An antenna unit according to claim 12, wherein the first dielectric volume is arranged between the radiating unit and the earth plane having the slot, and the second dielectric volume is arranged between the earth plane having the slot and the feeder to the slot.

17. An apparatus comprising a defined number of units for transmitting and receiving radio signals, each unit comprising a first antenna element for transmitting and receiving in a first polarization direction with a first beam width, and a second antenna element for transmitting and receiving in a second polarization direction with a second beam width, wherein the first antenna element is a single microstrip element comprising a radiating element of the type surface element, the second antenna element is a single slot, each of the first and the second antenna elements is arranged to transmit and receive only one polarization direction, the first and second antenna elements are arranged in a one-to-one relationship, the first and second beam widths are wider than 70 degrees, and the units are arranged in a column forming a sector antenna.

18. An apparatus according to claim 17, wherein the first polarization direction is vertical.

19. An apparatus according to claim 17, wherein the second polarization direction is horizontal.

20. An apparatus according to claim 17, wherein the apparatus further comprises a defined number of parallel columns having a defined number of units forming an antenna array.

21. An apparatus according to claim 17, wherein the slots are rectangular.

22. An apparatus according to claim 17, wherein the surface elements are rectangular.

23. An apparatus according to claim 17, wherein the first and second antenna elements operate in the same frequency band.

24. An apparatus according to claim 17, wherein the microstrip element is a patch, and the slot is a single slot, such that there is a one-to-one relationship between the first antenna element and the second antenna element.

25. An apparatus comprising a defined number of units for transmitting and receiving radio signals, each unit comprising a first antenna element of a first type for transmitting and receiving in a first polarization direction with a first beam width, and a second antenna element for transmitting and receiving in a second polarization direction with a second beam width; wherein the second antenna element is of a different type than the first antenna element; each of the first and the second antenna elements is arranged to transmit and receive only one polarization direction; the first and second beam widths are wider than 70 degrees; the units are arranged in a column forming a sector antenna; and the units are tilted a defined number of degrees relative to the longitudinal axis of the apparatus.

26. An apparatus comprising a defined number of units for transmitting and receiving radio signals, each unit comprising a first antenna element of a first type for transmitting and receiving in a first polarization direction with a first beam width, and a second antenna element for transmitting and receiving in a second polarization direction with a second beam width; wherein the second antenna element is of a different type than the first antenna element; each of the first and the second antenna elements is arranged to transmit and receive only one polarization direction; the first and second beam widths are wider than 70 degrees; the units are arranged in a column forming a sector antenna; and the units are tilted 45 degrees relative to the longitudinal axis of the apparatus.

* * * * *